United States Patent [19]

Dewitz

[11] Patent Number: 4,781,576

[45] Date of Patent: Nov. 1, 1988

[54] RETRACTABLE BURNER FOR COAL GASIFICATION PLANTS

[75] Inventor: Thomas S. Dewitz, Houston, Tex.

[73] Assignee: Shell Oil Company, Houston, Tex.

[21] Appl. No.: 129,877

[22] Filed: Dec. 4, 1987

Related U.S. Application Data

[63] Continuation of Ser. No. 901,118, Aug. 28, 1986, abandoned.

[51] Int. Cl.[4] ..... F23C 5/06

[52] U.S. Cl. ..... 431/186; 431/189; 110/322

[58] Field of Search ..... 431/2, 154, 186, 189; 110/322

[56] References Cited

U.S. PATENT DOCUMENTS

| | | | |
|---|---|---|---|
| 1,391,338 | 9/1921 | Morse | 431/189 |
| 3,150,710 | 9/1964 | Miller | 431/186 |
| 3,339,614 | 9/1967 | Fleck et al. | 431/186 |
| 4,073,627 | 2/1978 | Anderson | 48/62 |
| 4,445,444 | 5/1984 | Espedal | 110/261 |
| 4,588,557 | 5/1986 | Henderson | 431/189 X |

FOREIGN PATENT DOCUMENTS

| | | | |
|---|---|---|---|
| 21054 | 7/1930 | Australia | 431/186 |
| 1205043 | 10/1958 | France | 431/186 |

*Primary Examiner*—Randall L. Green

[57] ABSTRACT

An apparatus and method for retracting and inserting a shaft through a high pressure vessel while in operation comprising: a sleeve extending through a wall of the vessel, a shaft extending through the sleeve; a shield, compression seals, and valve to prevent materials within the vessel from escaping through the sleeve upon retraction of the shaft, and a prime mover connected to an end of the shaft outside the vessel wall for retracting and inserting the shaft.

4 Claims, 1 Drawing Sheet

RETRACTABLE BURNER FOR COAL GASIFICATION PLANTS

This is a continuation of application Ser. No. 901,118, filed Aug. 28, 1986, abandoned.

FIELD OF THE INVENTION

The present invention relates to an apparatus and method for retracting and inserting a shaft in a high pressure vessel while in operation and more particularly, to a burner carried by a shaft used in a synthesis gasification reactor vessel.

BACKGROUND OF THE INVENTION

The generation of synthesis gas is achieved by the partial combustion of particulate fuel such as coal at relatively high temperatures in the presence of oxygen or oxygen-containing gases. In the gasification process, a mixture of coal particles and fluid is fed from a source through supply lines to burners of a coal gasification reactor vessel. Generally, the discharge end of each burner is positioned to introduce the resulting flame and the agents of combustion into the gasification reactor vessel.

The burners in a synthesis gas production facility must effectively mix the reactants while at the same time be protected from overheating or chemical attack from the reactants.

Various coal gasification burner arrangements have been developed in an attempt to provide a structure which will achieve complete mixing of reactants and at the same time protect the burners from high temperatures (e.g., 3000 degrees Fahrenheit), high pressures (e.g., 500 psi), and chemical attack when the burners are in communication with the interior of the gasification reactor vessel. However due to the hostile environment to which the burners are exposed, it is recognized that the burners will have to be replaced approximately every six months. Replacement of the burners requires a shutdown of the gasification reactor vessel in the coal gasification system for several days to cool down the burners, replace them, and start up the system again. It is typically the life of these burners that determines the run length of time of the gasification system.

It is an object of the present invention to provide an apparatus and method for allowing retraction and insertion of burners while the gasification reactor vessel is still operating.

Applicant is not aware of any prior art which, in his judgment as one skilled in this particular art, would anticipate or render obvious the present invention. However, for the purpose of fully developing the background of the invention, and establishing the state of requisite art, the following art is set forth: U.S. Pat. Nos. 4,073,627 and 4,445,444.

SUMMARY OF THE INVENTION

The present invention is directed to an apparatus and method for retracting and inserting a shaft in a high pressure vessel while in operation. In a gasification reactor vessel of a coal gasification process, the invention utilizes burners that are capable of handling large quantities of coal, say from 1000 to 30,000 tons per day per gasification reactor vessel.

Each burner, which is carried at the front end of a hollow shaft, is inserted through a sleeve in the gasification reactor vessel wall so as to be in communication with the interior of the vessel. The rear end of the shaft may be operatively connected to a device, such as an engine, for retracting and inserting the shaft through the sleeve. A fluid, such as a purge gas, is forced under pressure into the sleeve to prevent materials within the gasification reactor vessel, such as syngas, etc. from escaping through the sleeve upon retraction of the burner from the gasification reactor vessel. Compression seals located near the rear end of the shaft between the outer wall of the shaft and sleeve further prevent materials from escaping from the gasification reactor vessel through the sleeve. A shield, such as a radiation shield, which is located between the purge gas and a position occupied by the front end of the shaft when fully inserted into the gasification reactor vessel may be provided to shield the burner from materials within the gasification reactor vessel.

An advantage of the present invention is that the burner can be retracted for isolation, maintenance, and/or replacement of the burner while the gasification reactor vessel is still operating thereby continuing to produce syngas without interruption.

Another advantage of the present invention is that it provides the capability to more quickly decrease or increase syngas production by removing or adding burners in response to downstream utility demands for varying syngas production amounts.

A further advantage of the present invention is an increased life of the gasification reactor vessel since the life expectancy of the vessel decreases each time the vessel is shut down and then started up.

The various features of novelty which characterize the invention are pointed out with particularity in the claims forming a part of this disclosure. For a better understanding of the invention, its operating advantages and specific objects obtained by its uses, reference should be made to the accompanying drawings and descriptive matter in which there are illustrated preferred embodiments of the invention.

DESCRIPTION OF THE PREFERRED EMBODIMENT

Figure 1:
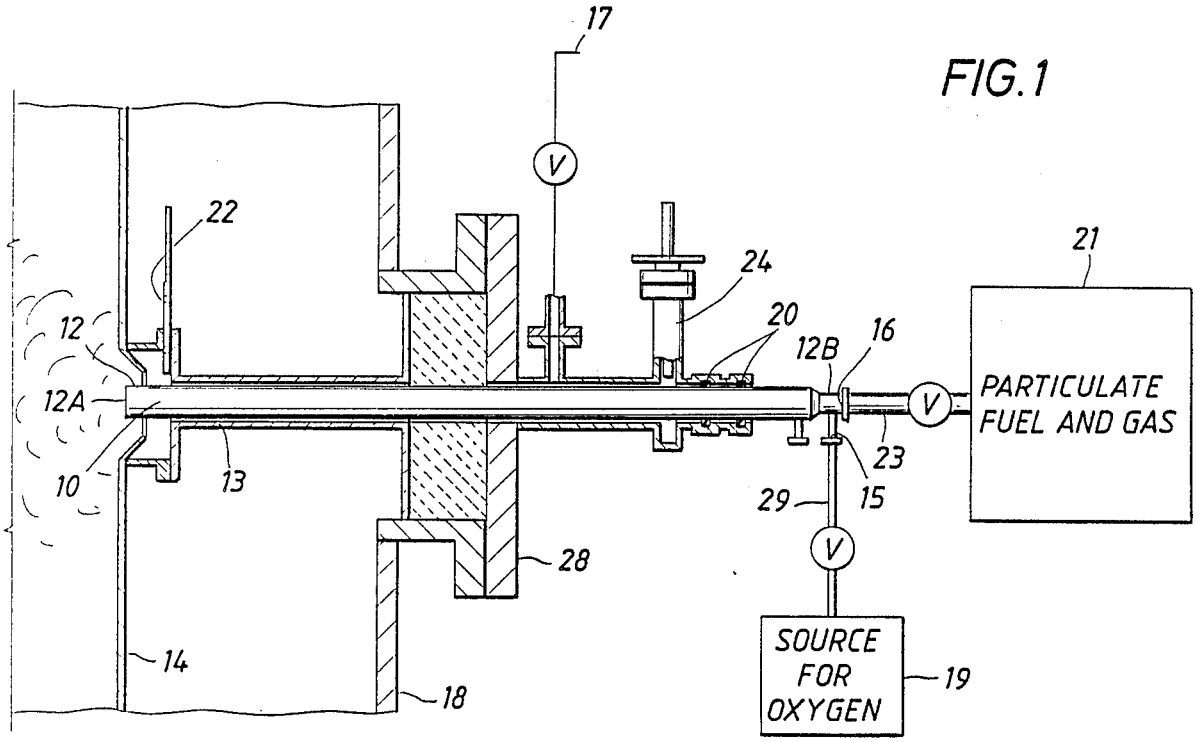
FIG. 1 is a cut-away view of an embodiment of the apparatus.

One embodiment of a partial combustion apparatus of the type generally contemplated is shown in FIG. 1. A burner 10 carried by a hollow shaft 12 having front and rear ends, 12A and 12B, respectively, is inserted in a sleeve 13 extending through an outer wall 18 and inner wall 14 of a gasification reactor vessel. A support flange 28 projecting outwardly from the outer wall 18 of the gasification reactor vessel holds the shaft 12 in place, and yet permits retraction and insertion.

The shaft 12 includes a port 15 for introducing oxygen or oxygen-containing gases from a source 19 via conduit 29 and a port 16 for introducing particulate fuel such as coal and gas from a source 21 via conduit 23 (hereinafter referred to as coal feed line) into the shaft. Thus, the two elements when introduced to the burner 10, will form a combustible mixture. The discharge end of the burner 10 is positioned to introduce agents of combustion and the resulting flame into the gasifier.

A fluid such as purge gas 17, e.g., nitrogen, carbon dioxide, or steam, is forced under pressure between the sleeve 13 and the shaft 12 to prevent materials within the vessel, such as coal, ash, and gas particles, from escaping through the sleeve 13 upon retracting the burner 10.

Compressions seals 20 between the sleeve 13 and the outer wall of the shaft 12 also prevent materials within the vessel from escaping through the sleeve 13 upon retracting the burner 10.

Figure 2:
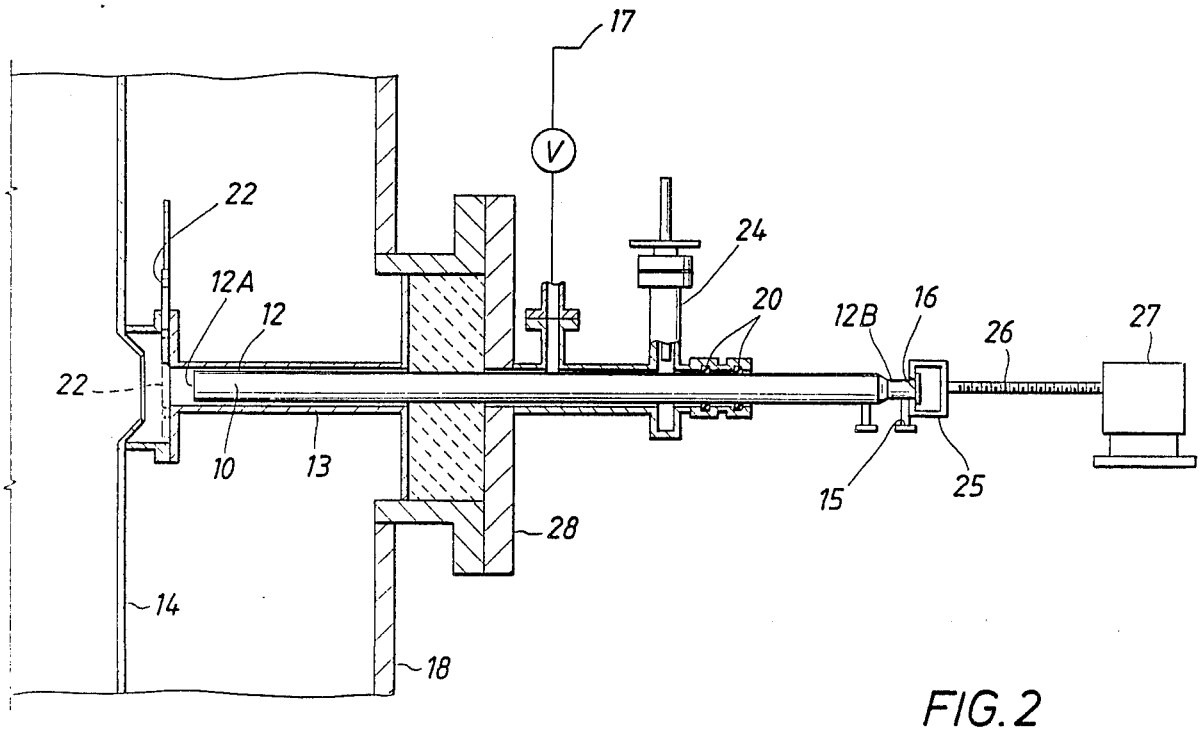
FIG. 2 is a cut-away view of an embodiment of the apparatus when partially retracted.

A shield 22 located between the position where the purge gas 17 is introduced and a position occupied by the front end 12A of the shaft 12 when fully inserted (FIG. 1) is operatively positioned to block the sleeve 13 when the shaft 12 is retracted as shown in FIG. 2. The shield 22 serves as a physical radiation shield from the materials within the gasification reactor vessel when the burner 10 is in a retracted position. For example, the shield could be made of porous material such as a ceramic material cooled by injecting steam through the porous material. It is recognized that this example is merely illustrative and that the shield 22 could be accomplished by any manner well known to the art.

A valve device, such as the block valve 24, located between the position where the purge gas 17 is introduced into the sleeve 13 and the rear end 12B of the shaft 12 may be used when the burner 10 is retracted further (not shown). An assembly for retracting the shaft 12 is shown for illustrative purposes in FIG. 2 as a gripper 25, threaded screw 26, and retraction engine 27.

In operation, the purge gas 17 is forced under pressure between the sleeve 13 and shaft 12 to prevent materials within the gasification reactor vessel from escaping The flows of oxygen-containing gases and particulate fuel and gas to the burner 10 are discontinued. The coal feed line 23 and conduit 29 are disconnected from the rear end 12B of the shaft 12 as shown in FIG. 2. However, it is recognized that disconnection of the coal feed line 23 may not be necessary for achieving retraction of the shaft 12 if, for example, the coal feed line 23 is made of a flexible material. The gripper 25, threaded screw 26, and retraction engine 27 are made operatively engageable with the rear end 12B of the shaft 12. The front end 12A of the shaft 12 is retracted to a selected distance based on the operation to be performed. If partial retraction of the burner 10 is desired, say for example to reduce the production of syngas, then the front end 12A of the shaft 12 is typically retracted a sufficient distance beyond shield 22 and shield 22 is activated to block the sleeve 13. However, if additional retraction of the burner 10 is desired, say for example to perform maintenance or replace the burner 10, then the front end 12A of the shaft 12 is retracted beyond the block valve 24 and the valve 24 is activated.

Thus, it can be seen that the above-mentioned objective may be accomplished, based on the description of the preferred embodiment, by practicing the above-described method.

What is claimed is:

1. An apparatus for retracting and inserting a burner shaft through a high pressure gasification vessel while in operation, said apparatus comprising:

a sleeve extending through a wall of said vessel in a fluid-tight manner and operative to guide a shaft into said vessel;

a retractable burner shaft extending through said sleeve in radially-spaced relationship therewith;

a prime mover associated with an end of said shaft which is outside said vessel wall, the prime mover being operative to move said shaft through said vessel wall;

sealing means operatively engaging said sleeve and the wall of said shaft at a first location to prevent materials from escaping from said vessel between said shaft and said sleeve;

a fluid adapted to be forced under pressure at a second location, in the wall of the sleeve nearer to the reactor than the sealing means, to occupy the space in said sleeve or between said sleeve and said shaft to prevent materials within said vessel from escaping through said sleeve upon retraction of said shaft;

movable blocking means located between said first and second locations to block said sleeve; whenever said shaft is retracted from said vessel and a shield operatively positioned to at least partially close said sleeve and located between said second location and a position occupied by the end of said shaft when fully inserted into said vessel.

2. The apparatus of claim 1 wherein said shaft includes first and second ports at an end of said shaft outside said vessel, said first port for introducing oxygen-containing gas into said shaft and said second port for introducing a particulate fuel and gas mixture into said shaft.

3. A method of selectively inserting a burner shaft through a wall of a high pressure gasification reactor vessel while in operation, said method comprising:

partially inserting said burner shaft within a radially-spaced sleeve extending through the vessel wall said shaft being inserted up to a blocking means located outside of said vessel;

sealing the space between the shaft and the sleeve at a first location outside the vessel wall;

admitting fluid under pressure in the space in the sleeve at a second location on the sleeve between said blocking means and the vessel wall;

opening said blocking means;

fully inserting said shaft into said sleeve to position said burner within said sleeve adjacent a radiation shield located between said second location and a position occupied by the end of said shaft when fully inserted into said vessel; and opening said radiation shield to fully insert said shaft into said reactor vessel.

4. A method of selectively retracting a burner shaft through a wall of high pressure gasification reactor vessel while in operation, said method comprising:

sealing a space between a burner shaft and a radially-spaced sleeve at a first location outside the vessel wall;

partially retracting said shaft within said sleeve which extends through the vessel wall, said shaft being retracted past a blocking means located outside of said vessel;

admitting fluid under pressure in the space between the shaft and the sleeve at a location between said blocking means and the vessel wall;

actuating said blocking means to block said sleeve;

removing said shaft from said sleeve;

providing a radiation shield location between the vessel wall and the location for admitting said fluid between the shaft and the sleeve; and actuating said radiation shield to at least partially close said sleeve.

* * * * *